United States Patent [19]

Wood

[11] Patent Number: 4,480,746

[45] Date of Patent: Nov. 6, 1984

[54] ARTICLE CARRIER

[75] Inventor: Prentice J. Wood, Hapeville, Ga.

[73] Assignee: The Mead Corporation, Dayton, Ohio

[21] Appl. No.: 596,590

[22] Filed: Apr. 3, 1984

[51] Int. Cl.[3] ..... B65D 75/00

[52] U.S. Cl. ..... 206/141; 206/161; 206/188; 229/DIG. 6

[58] Field of Search ..... 206/188, 141, 142, 161, 206/198, 200; 229/DIG. 6

[56] References Cited

U.S. PATENT DOCUMENTS

| | | | |
|---|---|---|---|
| 3,754,680 | 8/1973 | Wood | 206/188 |
| 4,308,950 | 1/1982 | Wood | 206/188 |
| 4,349,103 | 9/1982 | Wood | 206/188 |
| 4,374,561 | 2/1983 | Stout et al. | 206/188 |

*Primary Examiner*—Joseph Man-Fu Moy
*Attorney, Agent, or Firm*—Rodgers & Rodgers

[57] ABSTRACT

An article carrier of the basket style in which the opposed side and end walls are of the same height as a medial partition formed of two face contacting panels is provided with longitudinal finger gripping apertures formed in the face contacting medial panels and a reinforcing panel is struck from the area of one of the medial panels below the finger gripping apertures and adjacent the ends thereof and folded upwardly into face contacting relationship with the associated medial panel so as to afford reinforcement for the handle structure of the carrier.

7 Claims, 8 Drawing Figures

ARTICLE CARRIER

TECHNICAL FIELD

This invention pertains to article carriers of the basket style and is concerned with strengthening the handle structure of such a carrier by means of a reinforcement panel struck from one medial panel and folded upwardly into face contacting relationship therewith and secured thereto so as to strengthen the handle portion of the carrier in the region thereof immediately above finger gripping apertures formed in the face contacting medial panels.

BACKGROUND ART

Basket style article carriers of the type in which a pair of telescoping handle panels joined to one end of the carrier are arranged in telescoping relation with a similar pair of handle panels joined to the other end of the carrier are overlapped in such a way as to afford a four ply handle portion in which finger gripping apertures are formed. Such carriers afford adequate strength in the handle region for carriers of this general type. An example of a carrier of this type is shown in expired U.S. Pat. No. 2,537,452.

Basket style article carriers in which the side and end walls are of the same height as the medial partition structure are normally formed with a two-ply medial partition and finger gripping apertures are formed in the upper portion of the face contacting medial panels. In carriers of this type, maximum stress is applied to the medial panels near the ends of the finger gripping apertures. In the past, it has been customary in order to overcome this weakness to use rather thick paperboard stock to form such carriers in order to obtain adequate handle strength at these points of weakness.

DISCLOSURE OF THE INVENTION

For the purpose of increasing the handle strength in basket style carriers in which the side and end walls are of the same height as the medial partition structure, a reinforcing panel is struck from the part of one of the medial partition panels which is disposed below and adjacent the ends of elongated longitudinal aperture means formed in such one panel and such reinforcing panel is folded outwardly and upwardly into face contacting relation with the one medial partition panel and secured thereto by adhesive means. By this means the weak points in carriers of this type are reinforced with what constitutes a three ply structure the panels of which are secured to each other. One advantage which is derived from this invention resides in the fact that paperboard material which is of lighter weight may be used instead of the heavy guage paperboard which was necessary in accordance with prior practices.

BEST MODE OF CARRYING OUT THE INVENTION

Figure 1:
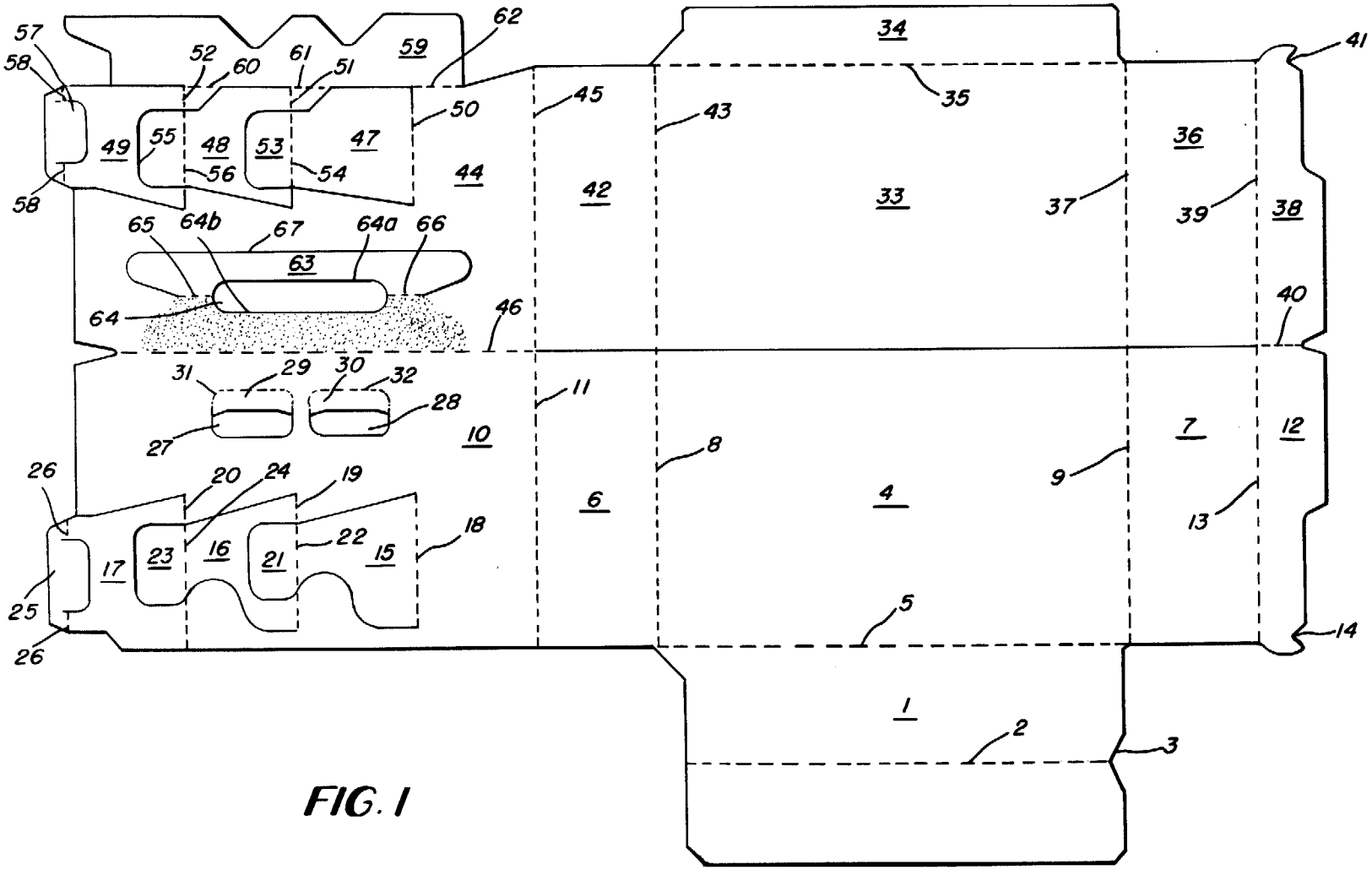
FIG. 1 is a plan view of a blank formed according to this invention.

With reference to FIG. 1, the numeral 1 designates a bottom wall in which a medial fold line 2 is formed and in which a locking notch 3 is provided at the end of fold line 2. Side wall 4 is foldably joined to bottom wall 1 along fold line 5 and end wall panels 6 and 7 are foldably joined to the end edges of side wall 4 along fold lines 8 and 9 respectively. A medial partition panel 10 is foldably joined to end wall panel 6 along fold line 11. Riser panel 12 is foldably joined to end wall panel 7 along fold line 13 and a locking notch 14 is formed in riser panel 12.

Partition structure associated with medial partition panel 10 includes transverse partition panels 15, 16, and 17 which are foldably joined to medial partition panel 10 respectively along fold lines 18, 19 and 20. Glue flap 21 is foldably joined to transverse partition panel 15 along fold line 22 while glue flap 23 is foldably joined to transverse partition panel 16 along fold line 24 and glue flap 25 is foldably joined to transverse partition panel 17 along a pair of aligned fold lines 26.

Handle structure is provided and includes aperture means 27 and 28 formed in medial partition panel 10 together with cushioning flap means 29 and 30 which are struck from aperture means 27 and 28 respectively and which are foldably joined to medial panel 10 along fold lines 31 and 32 respectively.

The other side of the blank includes side wall 33 to the bottom edge of which a glue flap 34 is foldably joined along fold line 35. End wall panel 36 is foldably joined to an end edge of side wall 33 along fold line 37. Riser panel 38 is foldably joined to end wall panel 36 along fold line 39 and is also foldably joined along its upper edge with riser panel 12 along fold line 40. A locking notch 41 is formed in riser panel 38.

At the other end of the carrier blank end wall panel 42 is foldably joined to side wall 33 along fold line 43 and medial partition panel 44 is foldably joined to end wall panel 42 along fold line 45. Medial partition panels 10 and 44 are foldably joined to each other along their top edges at the fold line 46.

Cross partition structure includes transverse partition panels 47, 48 and 49 which are foldably joined to medial partition panel 44 along fold lines 50, 51 and 52 respectively. Glue flap 53 is foldably joined to transverse partition panel 47 along fold line 54 while glue flap 55 is foldably joined to transverse partition panel 48 along fold line 56 and glue flap 57 is foldably joined to transverse partition panel 49 along aligned spaced apart fold lines 58.

For providing an anchoring strut medially of the carrier to which cross partition structure may be secured and which also interconnects the ends of the carrier medially thereof, a medial strut 59 is foldably joined to parts of medial partition panel 44 along fold lines 60, 61, and 62.

In accordance with a principal feature of this invention, a reinforcing panel 63 is struck from the portion of medial partition panel 44 which is disposed immediately below and adjacent the ends of longitudinal aperture means 64 which is formed in medial partition panel 44.

Figure 2:
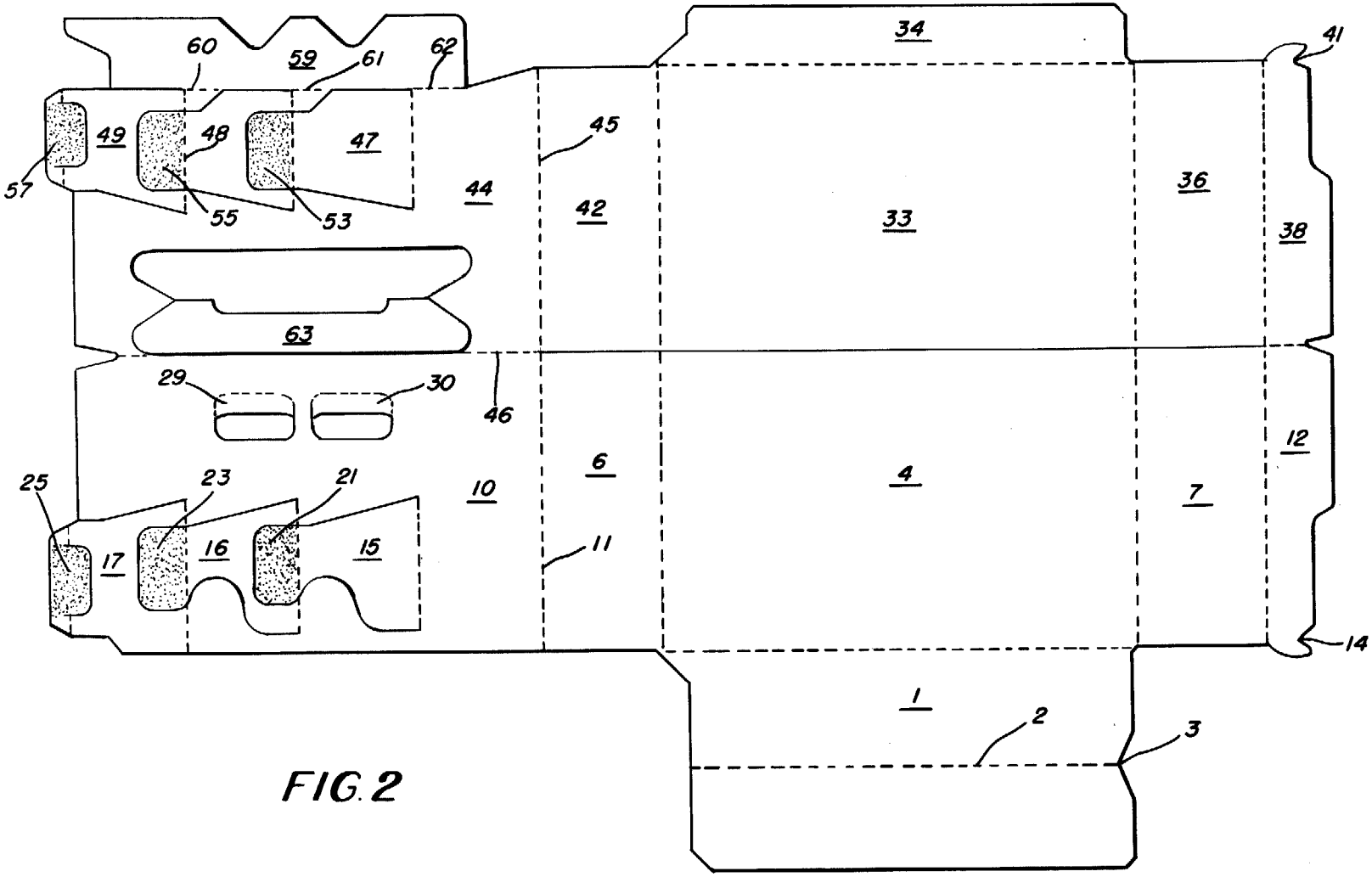
FIGS. 2–6 inclusive represent gluing and folding operations through which the blank of FIG. 1 is sequentially manipulated so as to form a complete collapsed carrier as shown in FIG. 7

In order to effect reinforcement near the elongated longitudinal aperture means 64 and more particularly to effect reinforcement of the medial partition panel 44 in the region adjacent the ends of longitudinal aperture means 64, reinforcing panel 63 is elevated and folded forwardly along aligned fold lines 65 and 66 to cause that panel to come into face contacting relation with the glued portion of panel 44 as indicated by stippling in FIG. 1. After this folding operation is complete the blank appears as shown in FIG. 2 with the reinforcing panel 63 adhered to medial panel 44 in such manner that its lower edge 67 is in general coincidence with the fold line 46, i.e., with the upper edges of medial panels 10 and 44. From FIG. 1 it is apparent that fold lines 65 and 66 are in general horizontal alignment and intersect the end portions of aperture means 64 approximately midway between the lower edge 64*a* and the upper edge 64*b* of aperture means 64.

Figure 3:
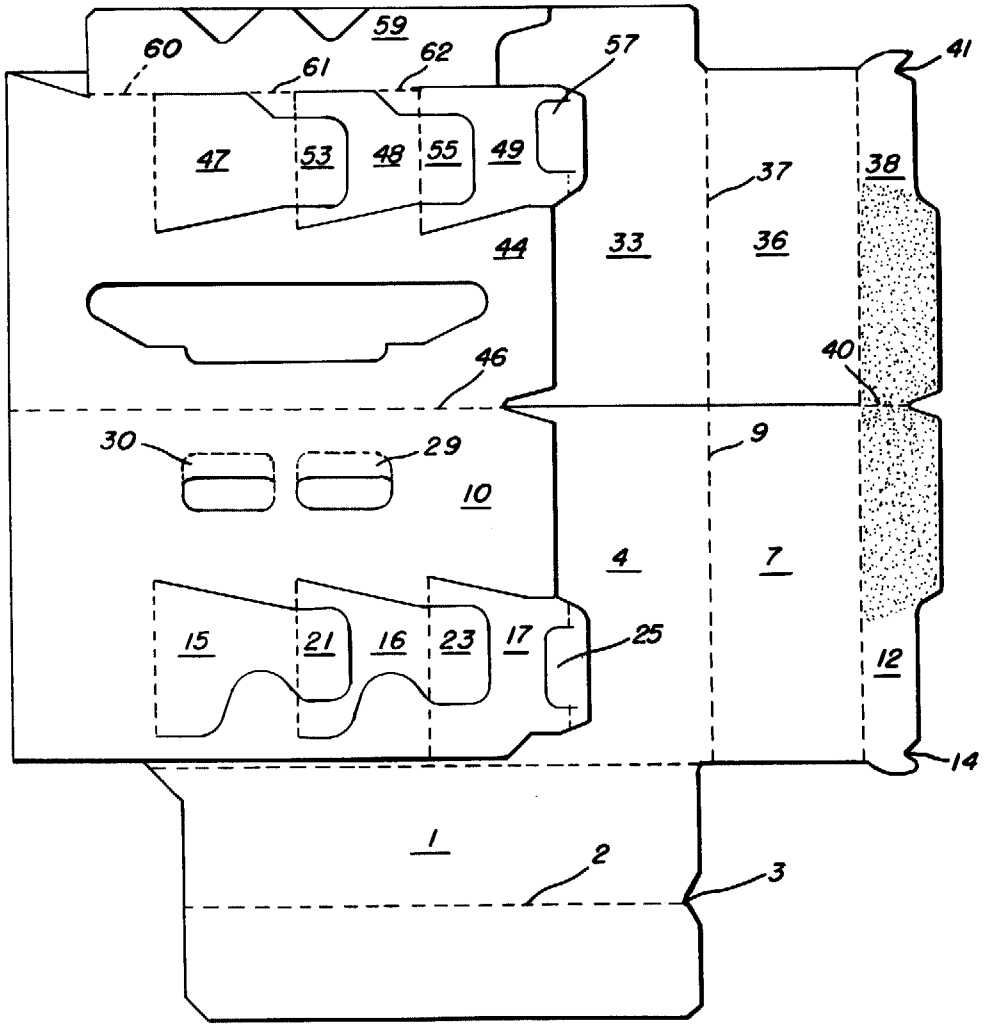

An application of glue is then made to the glue tabs 21, 23, 25, 53, 55, 57 as indicated by stippling in FIG. 2. Thereafter medial partition panels 10 and 44 are elevated and folded toward the right along fold lines 11 and 45. This operation causes the glue tabs 21, 23, and 25 to become adhered to the inner surface of the side wall 4 and simultaneously causes the glue flaps 53, 55, and 57 to become adhered to the inner surface of side wall 33 and the blank then appears as shown in FIG. 3.

An application of glue is then made to riser panels 12 and 38 as indicated by stippling in those panels. Following this application of glue, end wall panels 7 and 36 together with riser panels 12 and 38 are elevated and folded toward the left along fold lines 9 and 37. This operation causes the riser panel 12 to become adhered to the right hand portion of medial panel 10 and also causes the riser panel 38 to become adhered to the right hand portion of medial partition panel 44. The blank then appears as shown in FIG. 4.

Figure 4:
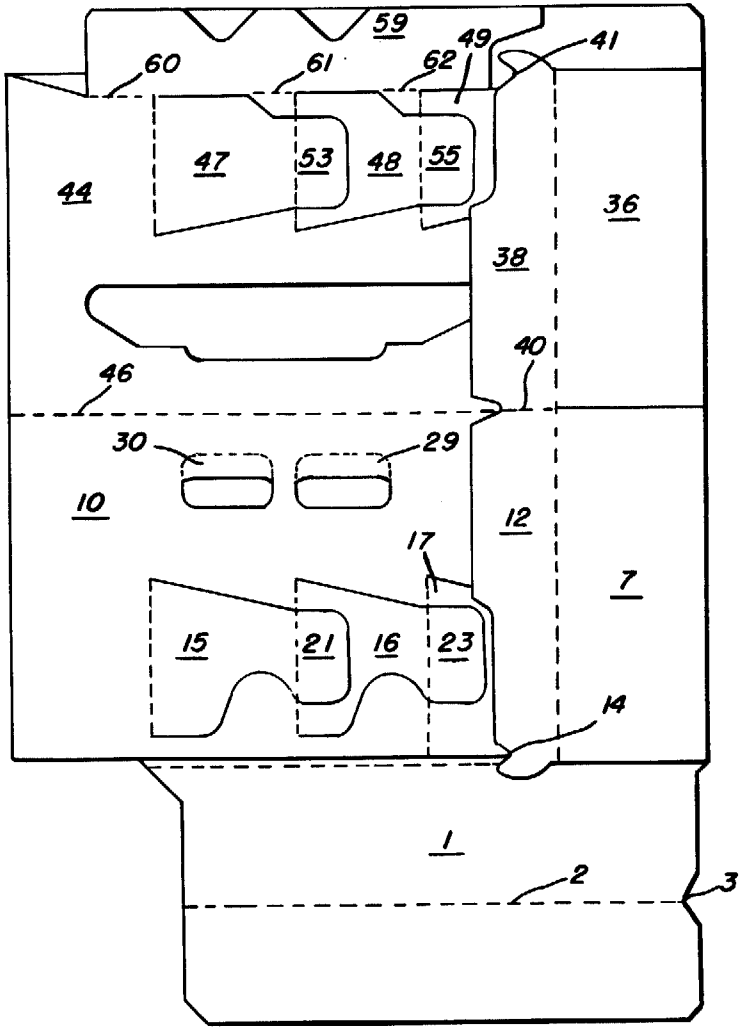
Figure 5:
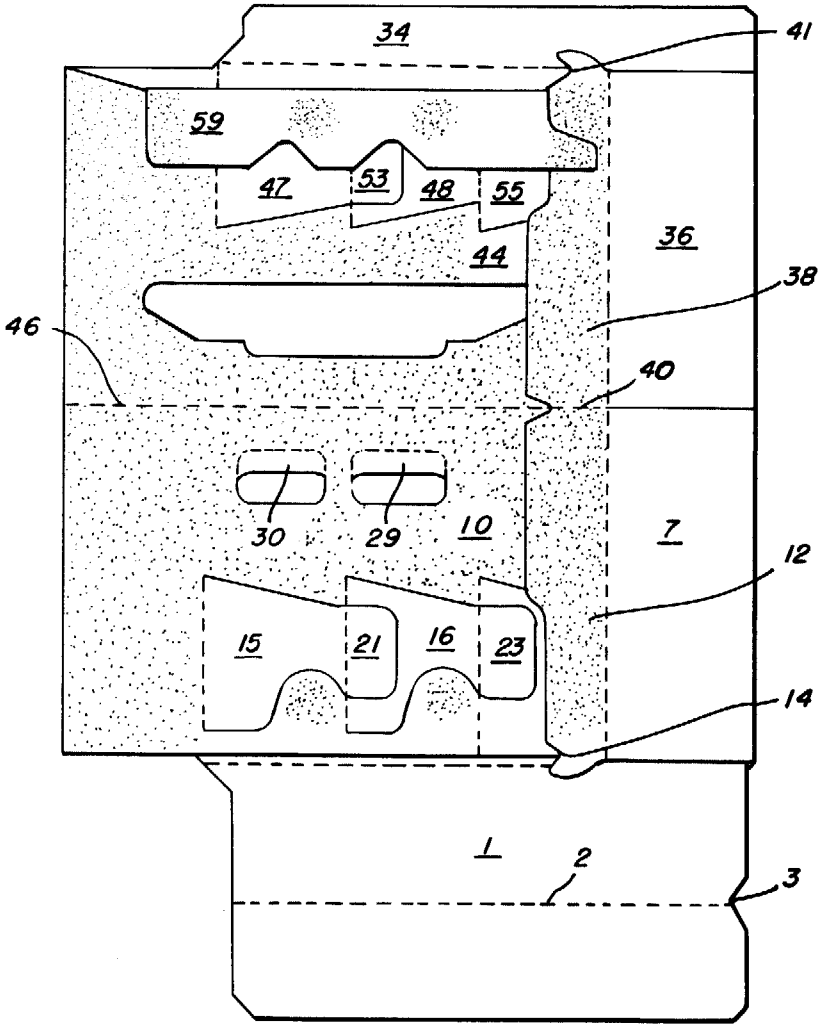

Thereafter the medial strut panel 59 as shown for example in FIG. 4 is folded forwardly along the fold lines 60, 61 and 62 to occupy the position shown in FIG. 5.

Thereafter an application of glue is made to medial partition panels 10 and 44 as well as to riser panels 12 and 38 and medial strut panel 59 as indicated by stippling in FIG. 5. Thereafter portions of the blank disposed above the fold lines 40 and 46 as shown in FIG. 5 are elevated and folded forwardly to occupy the positions shown in FIG. 6. Of course this folding operation causes the riser panels 12 and 38 to become adhered to each other and also causes the medial partition panels 10 and 44 to become adhered to each other and the strut panel 59 is secured between the riser panels 7 and 36 at its right hand end and between the medial panels 10 and 44 at its left hand end and at portions intermediate its length. This folding operation causes the locking notches 14 and 41 in riser panels 12 and 38 to fall into coincidental relation with respect to each other.

Figure 6:
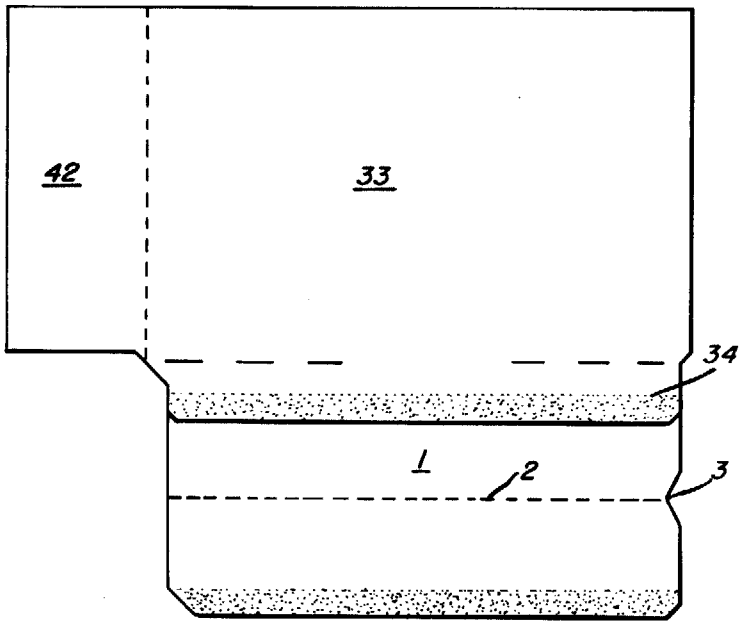

An application of glue is then made to the glue flap 34 and possibly to an edge of the bottom wall 1 as indicated by stippling in FIG. 6. Thereafter the bottom wall 1 is collapsed by folding the lower portion thereof below the fold line 2 upwardly and forwardly to cause the bottom wall 2 to become adhered to glue flap 34 and the carton then appears in completed collapsed form as shown in FIG. 7.

Figure 7:
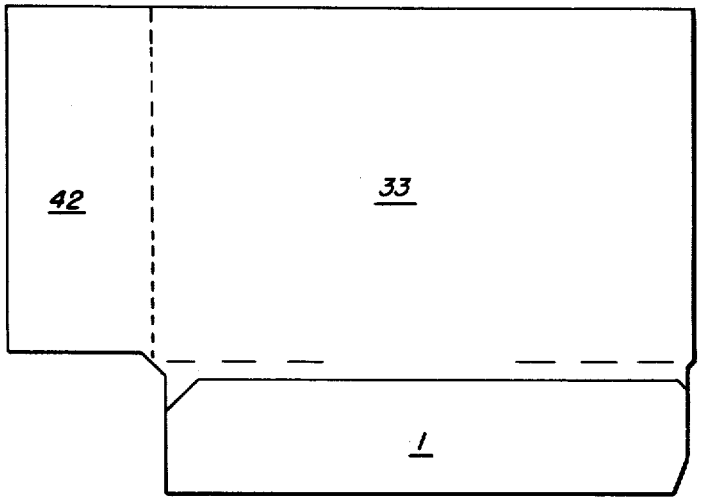
Figure 8:
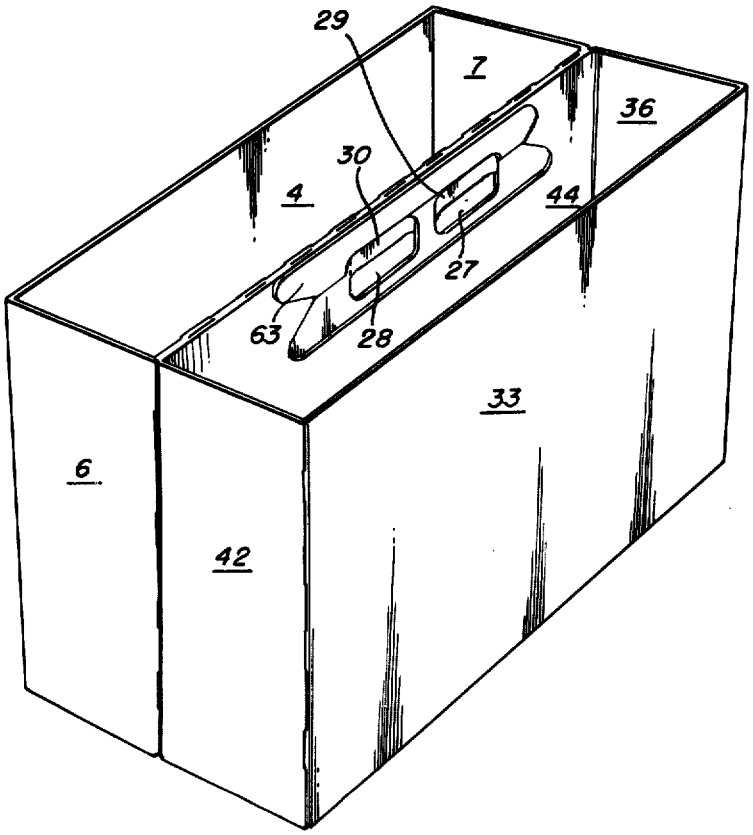
FIG. 8 is simply a perspective view of a set up carrier formed according to this invention.

In order to set the collapsed carton as shown in FIG. 7 into set up condition as shown in FIG. 8 it is simply necessary to hold the end wall panels 6 and 42 against movement toward the left and to apply a pressure toward the right to the right hand edges of side walls 33 and 4 to cause the composite locking notch 41 and 14 to engage the locking notch 3 after the side walls 33 and 4 are swung apart and the bottom wall 1 is manipulated into its flat set up condition. The carton then appears as shown in FIG. 8.

INDUSTRIAL APPLICABILITY

By this invention an article carrier of the basket style whose side and end walls are the same height as the medial partition structure is provided with a greatly strengthened handle portion formed in the medial partition structure. This improvement substantially increases the mechanical strength of the handle portion of the carrier and enables economies to be achieved by the use of paperboard material which is of less weight than conventional practices require.

I claim:

1. An article carrier comprising a bottom wall, a pair of side walls foldably joined respectively to the side edges of said bottom wall, end wall panels foldably joined respectively to the end edges of said side walls and extending inwardly therefrom, a medial partition panel foldably joined respectively at the ends thereof to the inner edges of the end wall panels on each side of the carrier and disposed in flat face contacting relation with each other and with their upper edges foldably joined together so as to form a double panel medial partition, adhesive means on the contacting faces of said medial partition panels to secure such panels together, elongated longitudinal aperture means formed in each of said medial partition panels the upper edges of which are disposed in general coincidence with each other, a reinforcing panel struck from the part of one of said medial partition panels which is disposed below and adjacent the ends of the elongated longitudinal aperture means formed therein, said reinforcing panel being folded outwardly and upwardly into face contacting relation with said one medial partition panel, and adhesive means arranged to secure said reinforcing panel to said one medial partition panel.

2. An article carrier according to claim 1 wherein said reinforcing panel is foldably joined to said one medial partition panel by a pair of horizontal aligned fold lines the inner ends of which intersect opposite ends of the elongated aperture means formed in said one medial partition panel.

3. An article carrier according to claim 1 wherein the upper edge of said reinforcing panel coincides generally with the foldably joined upper edges of said medial partition panels.

4. An article carrier according to claim 2 wherein said horizontal aligned fold lines respectively intersect opposite ends of said elongated aperture means formed in said one medial partition panel at points approximately midway between the upper and lower edges thereof.

5. An article carrier according to claim 1 wherein cushioning flap means is struck from the other of said medial partition panels and foldably joined thereto along the upper edge of the associated elongated longitudinal aperture means.

6. An article carrier according to claim 5 wherein said cushioning flap means comprises a pair of cushioning flaps.

7. An article carrier according to claim 1 wherein said elongated horizontal aperture means in the other of said medial partition panels comprises a pair of horizontally aligned apertures separated by a vertical strut disposed approximately midway between the ends of said elongated horizontal aperture means and integral with the other of said medial partition panels.

* * * * *